US005855043A

United States Patent [19]

Leifeld

[11] Patent Number: 5,855,043

[45] Date of Patent: Jan. 5, 1999

[54] CARDING MACHINE HAVING AN AFTER-CONNECTED SLIVER COILER PROVIDED WITH A SLIVER DRAWING UNIT

[75] Inventor: Ferdinand Leifeld, Kempen, Germany

[73] Assignee: Trützschler GmbH & Co. KG, Mönchengladbach, Germany

[21] Appl. No.: 881,611

[22] Filed: Jun. 25, 1997

[30] Foreign Application Priority Data

Jun. 29, 1996 [DE] Germany ..... 196 26 235.6
May 24, 1997 [DE] Germany ..... 197 21 758.3

[51] Int. Cl.[6] ..... D04H 11/00

[52] U.S. Cl. ..... 19/159 R; 19/98; 19/106 R; 19/150; 19/157

[58] Field of Search ..... 19/106 R, 98, 19/65 A, 150, 157, 159 R

[56] References Cited

U.S. PATENT DOCUMENTS

| | | | |
|---|---|---|---|
| 2,775,858 | 1/1957 | Kruse | 19/150 |
| 4,779,310 | 10/1988 | Leifeld | 19/106 R |
| 4,791,706 | 12/1988 | Wiening et al. | 19/106 |
| 4,827,574 | 5/1989 | Nakano et al. | 19/98 |
| 4,962,569 | 10/1990 | Hosel | 19/106 |
| 5,111,551 | 5/1992 | Hollingsworth et al. | 19/159 |
| 5,155,879 | 10/1992 | Kluttermann et al. | 19/159 |
| 5,230,125 | 7/1993 | Clement et al. | 19/150 |
| 5,272,790 | 12/1993 | Demuth et al. | 19/157 |
| 5,274,883 | 1/1994 | Eke | 19/65 A |
| 5,388,310 | 2/1995 | Haworth | 19/65 A |
| 5,400,476 | 3/1995 | White | 19/150 |
| 5,457,851 | 10/1995 | Mondini | 19/150 |
| 5,515,579 | 5/1996 | Hosel | 19/159 R |

FOREIGN PATENT DOCUMENTS

| | | | |
|---|---|---|---|
| 2 106 552 | 4/1983 | United Kingdom . | |
| 2225634 | 6/1990 | United Kingdom | 19/106 R |
| 2 235 472 | 3/1991 | United Kingdom . | |
| 2 277 106 | 10/1994 | United Kingdom . | |

*Primary Examiner*—William Stryjewski
*Attorney, Agent, or Firm*—Spencer & Frank

[57] ABSTRACT

An apparatus includes a carding machine which has a web trumpet gathering a running fiber web into sliver and a calender roll pair arranged immediately downstream of the web trumpet for pulling the sliver therethrough. The apparatus further includes a sliver coiler having a rotary coiler head through which the sliver passes and a first sliver trumpet having an inlet which constitutes the inlet opening for the coiler head. A sliver drawing unit is arranged at the inlet opening for the coiler head for drawing the sliver running therethrough prior to entering the coiler head. Further, a second sliver trumpet is arranged at the inlet end of the drawing unit for guiding the sliver thereto.

20 Claims, 5 Drawing Sheets

CARDING MACHINE HAVING AN AFTER-CONNECTED SLIVER COILER PROVIDED WITH A SLIVER DRAWING UNIT

CROSS REFERENCE TO RELATED APPLICATION

This application claims the priority of German Application Nos. 196 26 235.6 filed Jun. 29, 1996 and 197 21 758.3 filed May 24, 1997, which are incorporated herein by reference.

BACKGROUND OF THE INVENTION

This invention relates to a carding machine which, at its output, has a web trumpet with an after-connected pair of calender rolls, downstream of which—as viewed in the direction of sliver run—a sliver coiler is arranged which includes a rotary coiler head having a sliver inlet opening. A sliver drawing unit is disposed between the web trumpet and the sliver inlet opening of the coiler head.

In a known device a sliver drawing unit is provided between the stripper roll—which cooperates with the doffer of the carding machine—and the sliver coiler. At a distance from the stripper roll a web trumpet is disposed whose input is associated with a fiber web chamber while its output is situated immediately at the intake of the drawing unit. The web trumpet is thus arranged simultaneously at the output of the carding machine and at the input of the sliver drawing unit which is a regulated drawing unit. The web trumpet has a dual function: first, it forms, as an output trumpet at the carding machine, a sliver from the fiber web and guides, as an input trumpet, the sliver into the drawing unit. Second, the web trumpet serves as a measuring member to sense the sliver thickness. The thickness measurement signal affects, with the intermediary of regulating devices, the rpm of the feed roll at the input of the carding machine as well as the rpm of a roll pair of the regulated drawing unit. The drawing unit is arranged horizontally approximately at the height level of the stripper roll of the carding machine, and the web trumpet receives the approximately horizontally running sliver. The drawing unit is associated with the sliver coiler and is situated in a vertical direction approximately at one-half the height between the floor plate (platform) and the coiler head of the sliver coiler apparatus.

It is a disadvantage of the above-described arrangement that the web trumpet is, in the horizontal direction, at a distance from the stripper roll so that a web triangle is formed which is prone to rupture. Running speeds of above 100 m/min are not feasible with such an apparatus. It is a further drawback that between the outlet of the drawing unit and the sliver inlet opening of the coiler head of the sliver coiler a significant distance prevails so that the drawn and regulated sliver risks being exposed to unintended stretching along such a travel path, resulting in irregularities in the sliver.

SUMMARY OF THE INVENTION

It is an object of the invention to provide an improved apparatus of the above-outlined type from which the discussed disadvantages are eliminated and which, in particular, avoids external effects of the sliver between the drawing unit and the sliver intake opening of the coiler head and furthermore ensures a secure guidance of the sliver thereinto.

This object and others to become apparent as the specification progresses, are accomplished by the invention, according to which, briefly stated, the apparatus includes a carding machine which has a web trumpet gathering a running fiber web into sliver and a calender roll pair arranged immediately downstream of the web trumpet for pulling the sliver therethrough. The apparatus further includes a sliver coiler having a rotary coiler head through which the sliver passes and a first sliver trumpet having an inlet which constitutes the inlet opening for the coiler head. A sliver drawing unit is arranged at the inlet opening for the coiler head for drawing the sliver running therethrough prior to entering the coiler head. Further, a second sliver trumpet is arranged at the inlet end of the drawing unit for guiding the sliver thereto.

Thus, according to the invention two trumpets are provided, namely, a web trumpet in which the fiber web is gathered to form a sliver and a sliver trumpet arranged at the input (inlet end) of the sliver drawing unit mounted on the sliver coiler. By virtue of the fact that a web trumpet is present which is independent from the drawing unit, the fiber web is, at the outlet of the card immediately following the stripper roll, guided into the web trumpet so that the delicate web triangle is eliminated and running speeds of 300 m/min and above are feasible. By virtue of the fact that a sliver trumpet is situated at the input (inlet end) of the drawing unit independently from the web doffing at the carding machine, the output (outlet end) of the drawing unit is arranged immediately at the sliver inlet opening (that is, the inlet of the first sliver trumpet) for the coiler head so that the conventionally long and risky path of the regulated and drawn sliver is very significantly shortened to thus ensure a secure transfer of the sliver into the coiler head. By using two trumpets (that is, the web trumpet and the second sliver trumpet) contrary to conventional devices, a separation of functions is effected, and harmful effects on the fiber web and also on the regulated and drawn sliver are securely avoided in a simple and advantageous manner. It is of significance that the outlet of the sliver drawing unit is situated in the close vicinity of the sliver inlet opening of the coiler head. It is furthermore of importance that the web trumpet is situated in the close vicinity of the stripper roll.

The invention has the following additional advantageous features:

- The outlet of the drawing unit is situated above the level of the sliver inlet opening for the coiler head.
- The outlet of the drawing unit is situated at the height level of the sliver intake opening for the coiler head.
- The drawing unit is horizontally disposed.
- The drawing unit is vertically disposed.
- The drawing unit slopes downwardly in the direction of sliver travel, at an acute angle to the horizontal.
- The drawing unit slopes upwardly in the direction of sliver travel, at an acute angle to the horizontal.
- A deflecting roller is provided between the outlet of the drawing unit and the sliver inlet opening for the coiler head.
- The sliver enters into the sliver inlet opening for the coiler head in a short path from the outlet of the drawing unit of the sliver.
- The drawing unit is situated above the coiler head plate of the coiler apparatus.
- The drawing unit is situated between the outer boundary of the coiler head plate and the sliver inlet opening for the coiler head.

A preferred embodiment of the invention includes a regulating device to which a sliver thickness measuring device, a regulator and a setting device are connected. The measuring (sliver thickness sensing) device is incorporated in the sliver trumpet at the input of the drawing unit. Expediently, the setting device is composed of a regulating motor for driving at least one roll pair of the drawing unit and/or a regulating motor for the feed roller of the carding machine at the input thereof.

DESCRIPTION OF THE PREFERRED EMBODIMENTS

Figure 1:
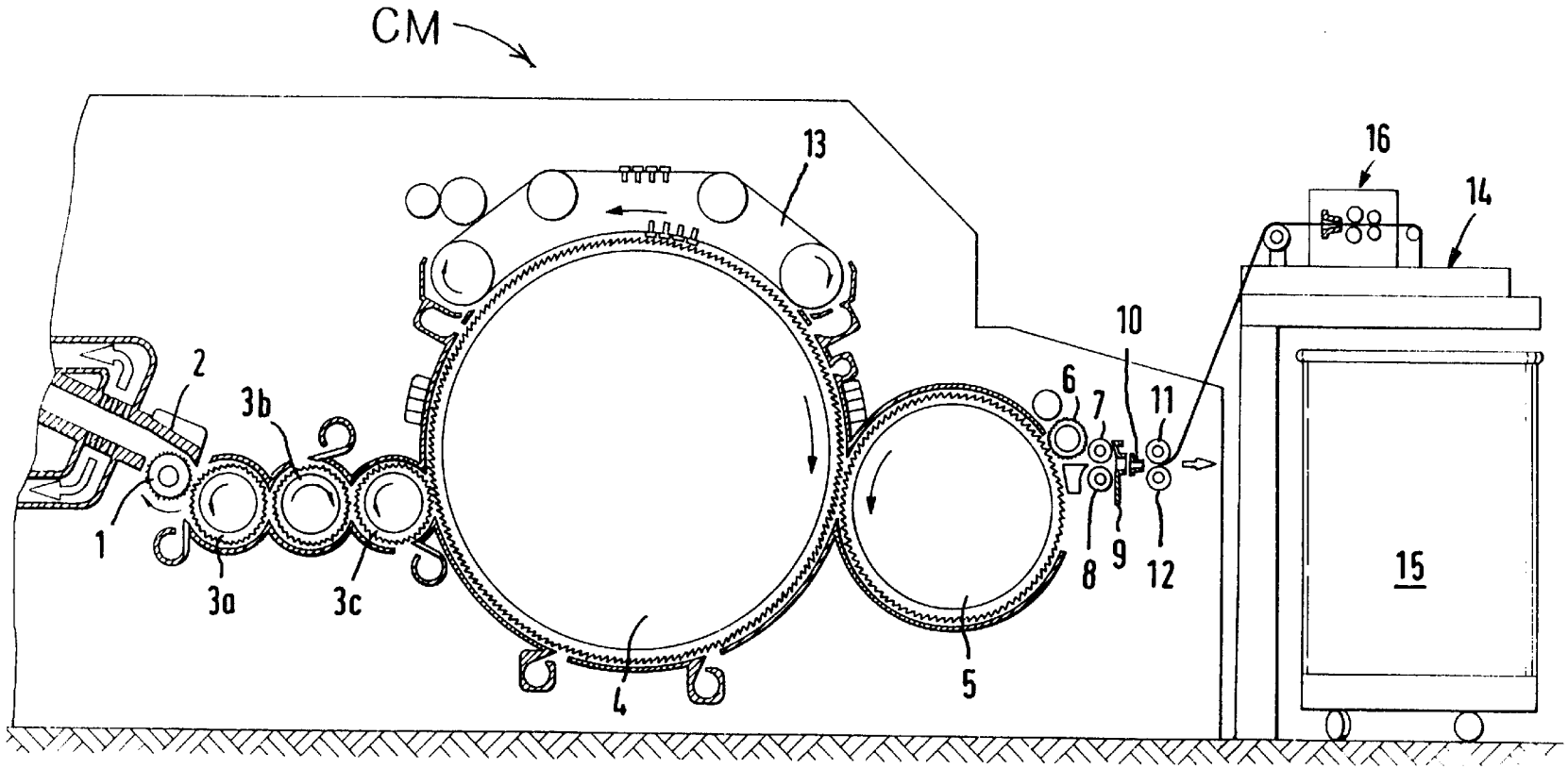
FIG. 1 is a schematic side elevational view of a carding machine and an after-connected sliver coiler, incorporating the invention.

FIG. 1 shows a carding machine CM which may be an EXACTACARD DK 803 model, manufactured by Tr ützschler GmbH & Co. KG, Mönchengladbach, Germany. The carding machine CM has a feed roller 1, a feed table 2 cooperating with the feed roller 1, licker-ins 3*a*, 3*b*, 3*c*, a main carding cylinder 4, a doffer 5, a stripper roll 6, crushing rolls 7, 8, a web guiding element 9, a web trumpet 10, calender rolls 11, 12, travelling flats 13 and a sliver coiler apparatus 14 feeding sliver to a coiler can 15. Above the sliver coiler 14 a sliver drawing unit 16 is disposed.

Figure 2:
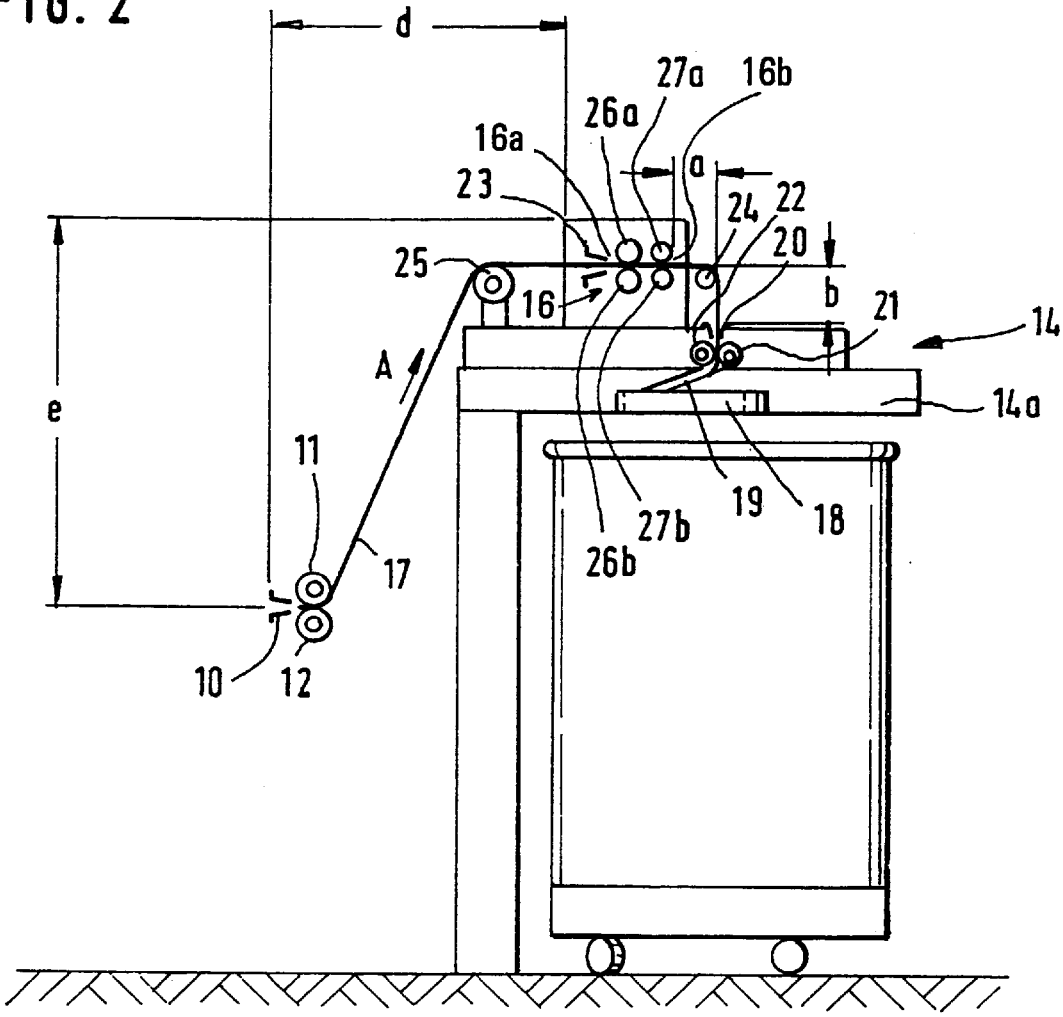
FIG. 2 is a view similar to FIG. 1 wherein the carding machine is not shown in detail and wherein the sliver drawing unit is arranged essentially horizontally above the coiler head plate of the sliver coiler.
Figure 2A:
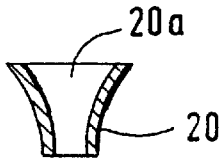
FIG. 2*a* is a schematic cross-sectional view of a sliver trumpet forming an inlet device for the coiler head.

As shown in FIG. 2, downstream of the calender rolls 11, 12 the sliver coiler 14 is situated, having a coiler head 18 which is provided with a sliver guiding tube 19 and which is positioned in a coiler head plate 14*a*. The sliver inlet opening for the coiler head 18 is formed of the upstream (inlet) opening 20*a* of a sliver trumpet 20 which is adjoined immediately downstream by a pair of pull-off rollers 21, 22. The cross-sectional configuration of the sliver trumpet 20 is shown in FIG. 2*a*. The sliver drawing unit 16 is arranged between the web trumpet 10 of the carding machine CM and the sliver inlet opening 20*a* for the coiler head 18.

At the inlet end 16*a* of the drawing unit 16 a sliver trumpet 23 is disposed. The sliver drawing unit 16 is oriented horizontally and is thus parallel to the coiler head plate 14*a*.

Between the outlet end 16*b* of the sliver drawing unit 16 and the sliver inlet opening 20*a* for the coiler head 18 a deflecting roller 24 is provided which thus divides the path of the sliver 17 from the drawing unit 16 to the coiler head 18 into respective horizontal and vertical path portions a and b. The length a+b of the sliver path between the outlet end 16*b* of the sliver drawing unit 16 and the inlet opening 20*a* for the coiler head 18 is maintained as short as possible and is preferably in the range of between 5 and 30 cm. The sliver drawing unit 16 is situated above the coiler head plate 14*a* between the outer boundary thereof and the sliver inlet opening 20*a* for the coiler head 18. Upstream of the sliver trumpet 23 a deflecting roll 25 is arranged for the sliver 17.

The sliver drawing unit 16 has two upper rolls 26*a*, 27*a* and two respective, associated lower rolls 26*b*, 27*b*. The upper rolls 26*a*, 27*a* rotate counterclockwise, while the lower rolls 26*b*, 27*b* rotate clockwise. The sliver drawing unit 16 is at a horizontal distance d and at a vertical distance e from the web trumpet 10.

In operation, the non-illustrated fiber web is gathered by the web trumpet 10 to form a sliver 17 which is pulled through the web trumpet 10 by the calender rolls 11, 12 at a speed of, for example, 200 m/min. The sliver 17 runs in the direction A upwardly toward and over the deflecting roller 25 and then passes, essentially in a horizontal direction, through the sliver trumpet 23 into the sliver drawing unit 16 and is drawn by the roll pair 26*a*, 26*b* and 27*a*, 27*b*. Thereafter the drawn sliver 17 is, as it exits from the drawing unit 16, guided over the deflecting roller 24 vertically downwardly and is introduced into the sliver trumpet 20. The sliver 17 is pulled through the sliver trumpet 20 by pull-off rollers 21, 22 and then passes through the orbiting guide tube 19 whereupon the sliver enters into the coiler head 18 (which rotates about a vertical axis) and exits the sliver outlet opening at the underside of the coiler head 18 into the coiler can 15 where it is deposited in coils.

Figure 3:
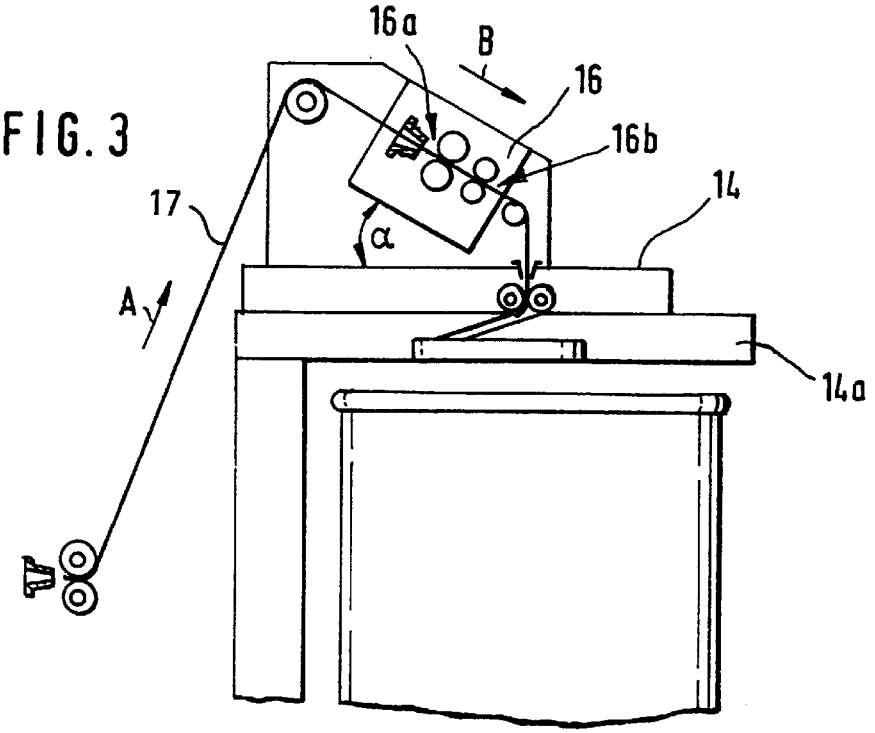
FIG. 3 is a schematic fragmentary side elevational view of a sliver coiler illustrating the sliver drawing unit sloping downwardly towards the coiler head plate as viewed in the direction of sliver run.
Figure 4:
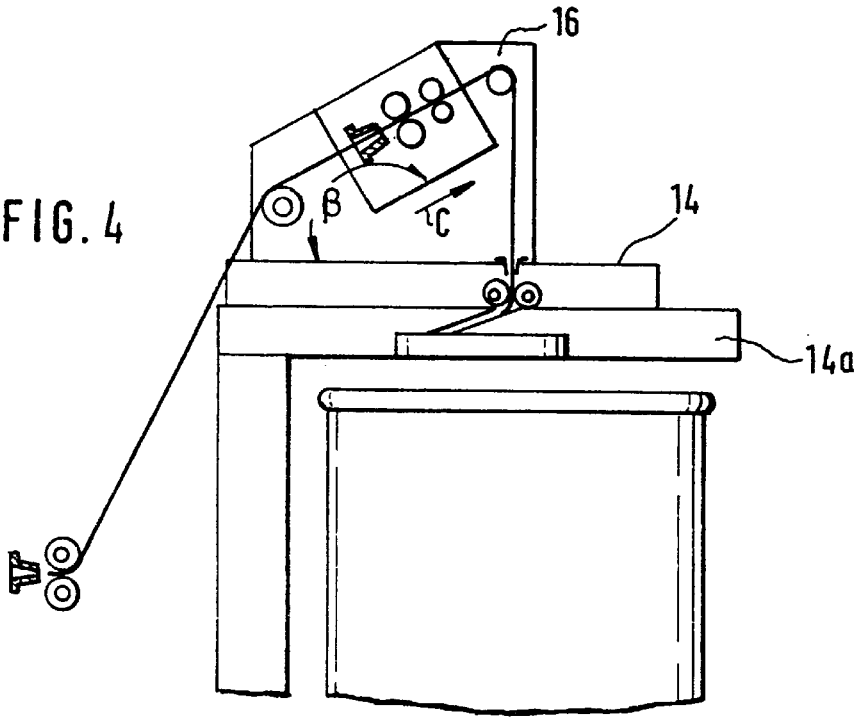
FIG. 4 is a schematic fragmentary side elevational view of a sliver coiler illustrating the sliver drawing unit sloping upwardly from the coiler head plate as viewed in the direction of sliver run.

Turning to FIG. 3, the sliver 17 runs downwardly in the sliver drawing unit 16 in the direction B toward the coiler head plate 14*a*. Stated differently, the drawing unit 16 slopes downwardly towards the coiler head plate 14*a*. In the arrangement according to FIG. 4, the sliver 17 runs upwardly in the sliver drawing unit 16 in the direction C away from the coiler head plate 14*a*. Stated differently, the drawing unit 16 slopes upwardly away from the coiler head plate 14*a*.

Figure 5:
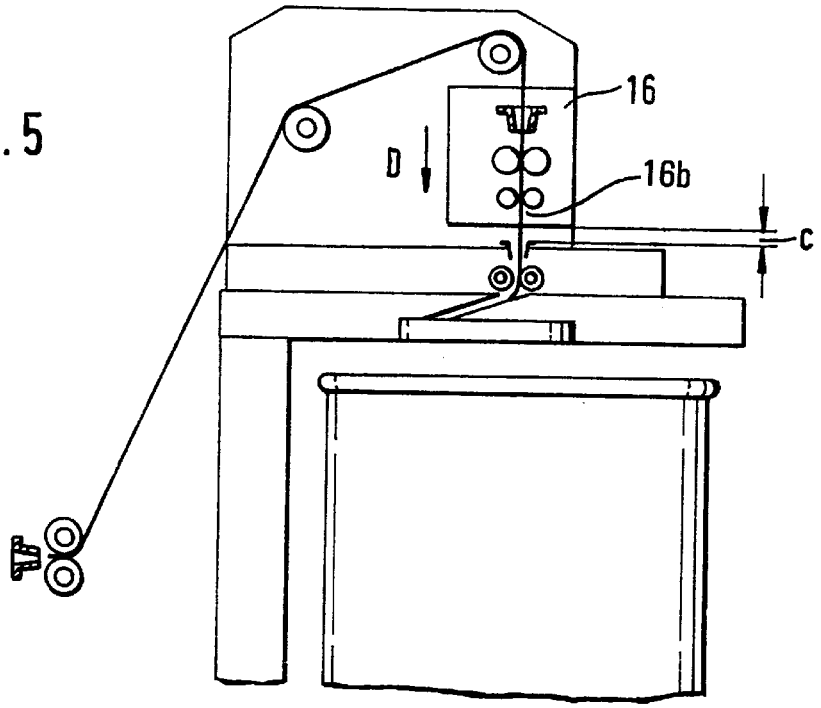
FIG. 5 is a view similar to FIG. 3 showing the sliver drawing unit arranged essentially at a vertical orientation above the coiler head plate.

FIG. 5, the direction D of the sliver run through the sliver drawing unit 16 is vertical, that is, it is oriented perpendicularly to the horizontal coiler head plate 14*a*. The outlet 16*b* of the sliver drawing unit 16 is at a short distance c from the inlet opening 20*a* for the coiler head 18.

Figure 6:
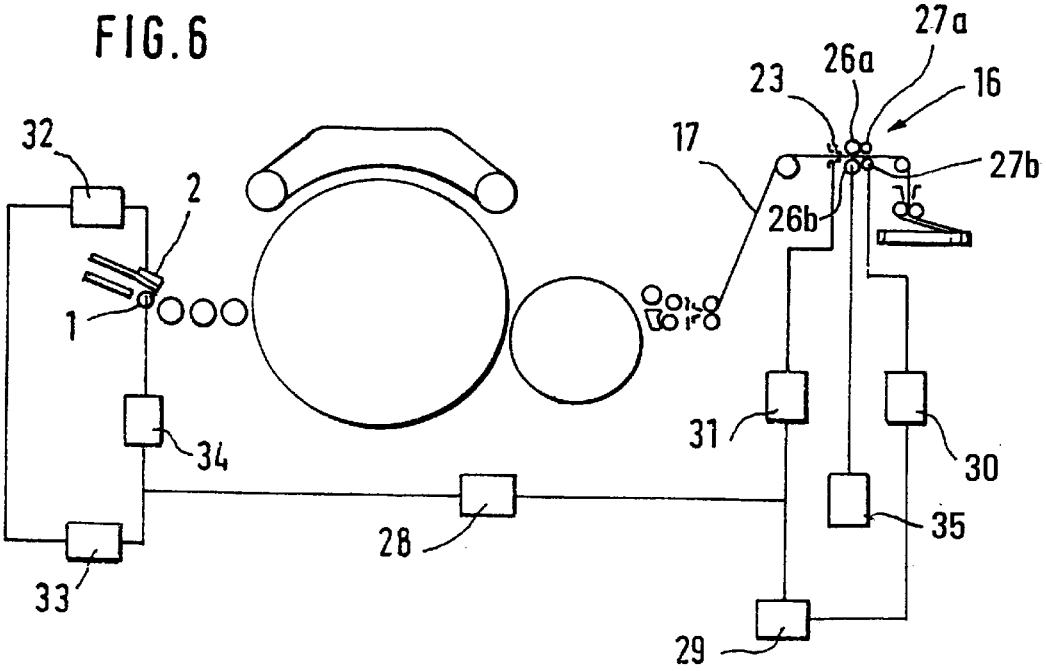
FIG. 6 is a schematic side elevational view, with block diagram, of an electronic regulating and control unit to which at least one regulating motor of the sliver drawing unit, the sliver measuring trumpet and the regulating motor for the feed roll of the carding machine are connected.

Turning to FIG. 6, there is shown a microcomputer-based control and regulating device 28 to which a regulator for the sliver drawing unit 16 and a regulator for the feed roller 1 of the carding machine are connected.

The sliver trumpet 23 at the inlet 16*a* of the sliver drawing unit 16 includes a measuring device for measuring, for example, by mechanical contacting, the thickness of the sliver 17. The measuring trumpet 23 is connected by means of a regulator 29 with the rpm-controllable drive motor 30, for example, a d.c. motor which rotates the roll 27*b*. Further, the measuring trumpet 23 is connected to the electronic control and regulating device 28, for example, via a non-illustrated measuring value transducer and a measuring value amplifier 31. The feed roller 1 is associated with a measuring member 32 for measuring the thickness of the fiber lap situated between the feed roller 1 and the feed table 2. The measuring member 32 is connected via a regulator 33 with the rpm-controlled drive motor 34, for example, a d.c.

motor which rotates the feed roller 1. The regulator is, in turn, connected with the electronic control and regulating apparatus 28. The roll pair 26*a*, 26*b* is rotated by a main motor 35 having a constant rpm.

Figure 7:
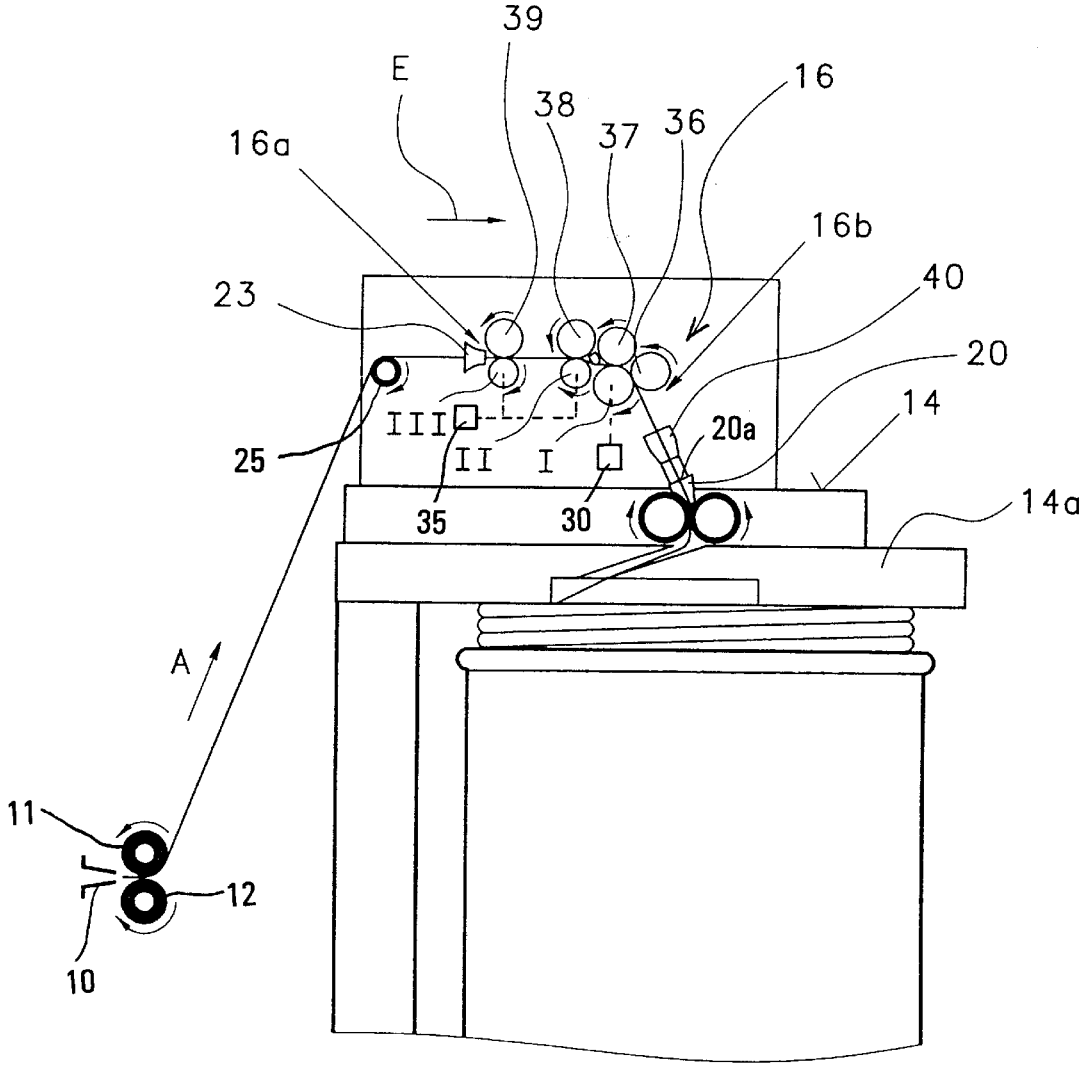
FIG. 7 is a schematic side elevational view illustrating a 4-over-3 drawing unit mounted on a sliver coiler incorporating the invention.

Turning to FIG. 7, the sliver drawing unit 16 is formed by a "4-over-3" drawing unit, that is, it has four consecutive upper rolls 36, 37, 38, 39 and three consecutive lower rolls I (forming the lower output roll), II (forming the lower middle roll) and III (forming the lower input roll). The roll pairs 39, III and 38, II form the pre-drawing field, while the roll pairs 38, II and 36, 37, I form the main drawing field. The lower output roll I is rotated by the rpm-regulated motor 30 (controlled in the manner described in connection with FIG. 6), while the lower input and middle rolls III and II are rotated by the constant-rpm main motor 35 and thus determine the delivery speed of the sliver. A sliver guiding element 40 is disposed between the outlet end 16*b* of the drawing unit 16 and the inlet 20*a* of the sliver trumpet 20.

The 4-over-3 drawing unit 16 of FIG. 7 may be modified, for example, by omitting the upper roll 36, whereby a 3-over-3 drawing unit is obtained.

It will be understood that the above description of the present invention is susceptible to various modifications, changes and adaptations, and the same are intended to be comprehended within the meaning and range of equivalents of the appended claims.

What is claimed is:

1. An apparatus comprising (a) a carding machine including an output zone; said carding machine including (1) a web trumpet positioned in said output zone for gathering a running fiber web into sliver; and (2) a calender roll pair arranged immediately downstream of the web trumpet as viewed in a running direction of the sliver for pulling the sliver through said web trumpet;

(b) a sliver coiler arranged downstream of said carding machine and having (1) a rotary coiler head through which the running sliver passes; and (2) a first sliver trumpet arranged at said coiler head and having an inlet constituting an inlet opening for said coiler head;

(c) a sliver drawing unit arranged at said inlet opening for drawing the sliver running therethrough prior to entering said inlet opening; said sliver drawing unit having an inlet end and an outlet end; and (d) a second sliver trumpet arranged at said inlet end of said drawing unit for guiding the sliver to said sliver drawing unit.

2. The apparatus as defined in claim 1, further comprising means for defining a sliver path from said outlet end of said sliver drawing unit directly to said inlet opening for said coiler head; said path having a short length.

3. The apparatus as defined in claim 1, wherein said outlet end of said sliver drawing unit is situated above said inlet opening for said coiler head.

4. The apparatus as defined in claim 1, wherein said outlet end of said sliver drawing unit is situated at a height level of said inlet opening for said coiler head.

5. The apparatus as defined in claim 1, wherein said sliver drawing unit is horizontally oriented.

6. The apparatus as defined in claim 1, wherein said sliver drawing unit is vertically oriented.

7. The apparatus as defined in claim 1, wherein said sliver drawing unit slopes obliquely downwardly toward said coiler head, as viewed in a direction of sliver run through said sliver drawing unit.

8. The apparatus as defined in claim 1, wherein said sliver drawing unit slopes obliquely upwardly from said coiler head, as viewed in a direction of sliver run through said sliver drawing unit.

9. The apparatus as defined in claim 1, further comprising a deflecting roller for guiding the sliver; said deflecting roller being positioned between said outlet end of said sliver drawing unit and said inlet opening for said coiler head.

10. The apparatus as defined in claim 1, wherein said sliver coiler further comprises a coiler head plate supporting said coiler head; said coiler head plate having an outer periphery; said sliver drawing unit being situated between said outer periphery and said inlet opening for said coiler head.

11. The apparatus as defined in claim 1, wherein said sliver drawing unit is spaced from said calender roller pair.

12. The apparatus as defined in claim 1, further comprising (a) a sliver thickness measuring device incorporated in said sliver trumpet; and (b) a setting device connected to a rotary component of the apparatus for setting the rpm of the rotary component; said setting device being operatively connected to said measuring device for responding to signals generated by said measuring device.

13. The apparatus as defined in claim 12, wherein said sliver drawing unit includes a plurality of serially arranged drawing roll pairs and further wherein said setting device is a regulating motor connected to one of said roll pairs; said one roll pair forming said rotary component.

14. The apparatus as defined in claim 12, wherein said carding machine includes a feed roller and further wherein said setting device is a regulating motor connected to said feed roller; said feed roller forming said rotary component.

15. The apparatus as defined in claim 1, wherein said sliver drawing unit includes a plurality of serially arranged roll pairs and said carding machine includes a feed roller; further comprising (a) an electronic control and regulating device;

(b) a sliver thickness measuring device incorporated in said sliver trumpet and connected to said electronic control and regulating device;

(c) a first regulating motor connected to said electronic control and regulating device and said feed roller; and (d) a second regulating motor connected to said electronic control and regulating device and one of said roll pairs of said sliver drawing unit.

16. The apparatus as defined in claim 1, wherein said drawing unit is a 4-over-3 drawing unit having a first upper roll cooperating with a lower input roll, a second upper roll cooperating with a lower middle roll and third and fourth upper rolls cooperating with a lower output roll.

17. The apparatus as defined in claim 16, further comprising an rpm-regulated motor drivingly connected to said lower output roll.

18. The apparatus as defined in claim 17, further comprising a constant-rpm main motor drivingly connected to said lower input roll and said lower middle roll.

19. The apparatus as defined in claim 1, wherein said drawing unit is a 3-over-3 drawing unit having a first upper roll cooperating with a lower input roll, a second upper roll cooperating with a lower middle roll and a third upper roll cooperating with a lower output roll.

20. An apparatus comprising (a) a carding machine including an output zone; said carding machine including (1) a web trumpet positioned in said output zone for gathering a running fiber web into sliver; and (2) a calender roll pair arranged immediately downstream of the web trumpet as viewed in a running direction of the sliver for pulling the sliver through said web trumpet;

(b) a sliver coiler arranged downstream of said carding machine and having (1) a rotary coiler head through which the running sliver passes; and (2) a first sliver trumpet arranged at said coiler head and having an inlet constituting an inlet opening for said coiler head;

(c) a sliver drawing unit arranged at said inlet opening for drawing the sliver running therethrough prior to entering said inlet opening; said sliver drawing unit having an inlet end and an outlet end;

(d) a second sliver trumpet arranged at said inlet end of said drawing unit for guiding the sliver to said sliver drawing unit; and (e) means for defining a sliver path from said outlet end of said sliver drawing unit to said inlet opening for said coiler head; said path having a length of between 5 and 30 cm.

* * * * *